US006150949A

United States Patent [19]

Eschbach et al.

[11] Patent Number: 6,150,949

[45] Date of Patent: Nov. 21, 2000

[54] OPTICAL DISPLAY DEVICE

[75] Inventors: Bernd Eschbach, Karlsruhe; Erwin Baumstark, Kuppenheim, both of Germany

[73] Assignee: Damback-Werke GmbH, Kuppenheim, Germany

[21] Appl. No.: 09/242,184

[22] PCT Filed: Aug. 5, 1997

[86] PCT No.: PCT/EP97/04264

§ 371 Date: Feb. 8, 1999

§ 102(e) Date: Feb. 8, 1999

[87] PCT Pub. No.: WO98/06086

PCT Pub. Date: Feb. 12, 1998

[30] Foreign Application Priority Data

Aug. 7, 1996 [DE] Germany ..... 196 31 827

[51] Int. Cl.[7] ..... G08B 5/00; G08G 1/095

[52] U.S. Cl. ..... 340/815.4; 340/815.47; 340/815.83; 340/815.68; 340/321; 340/908; 340/485; 340/488; 40/573; 40/612; 116/63 P

[58] Field of Search ..... 340/815.4, 815.47, 340/815.77, 815.64, 815.68, 815.83, 815.84, 815.86, 321, 485, 482, 483, 484, 908, 487–489; 345/33; 40/451, 612, 573, 614; 362/800; 116/63 P

[56] References Cited

U.S. PATENT DOCUMENTS

| | | | |
|---|---|---|---|
| D. 417,517 | 12/1999 | Seale | D26/25 |
| 3,593,418 | 7/1971 | Evans | 340/473 |
| 5,339,765 | 8/1994 | Ward | 116/63 P |
| 5,542,203 | 8/1996 | Luoma et al. | 340/908 |

FOREIGN PATENT DOCUMENTS

| | | |
|---|---|---|
| 0 413 877 A 1 | 2/1991 | European Pat. Off. . |
| 3440856 A 1 | 5/1985 | Germany . |
| 86 07 138 | 9/1986 | Germany . |
| 40 22 650 C 1 | 7/1991 | Germany . |

*Primary Examiner*—Donnie L. Crosland
*Attorney, Agent, or Firm*—Jansson, Shupe, Bridge & Munger, Ltd.

[57] ABSTRACT

An optical display device for the representation of signs, especially road signs, in a display frame attached to a support device. The display frame is comprised of strip-shape display segments located at a distance from each other. In order to obtain a small-sized display device perpendicular to the direction in which an observer moves, the support device is aligned in a substantially parallel position to the given direction in which the observer moves, and the display frame is designed to include several display segments, located at a distance from each other, placed behind each other in the direction of movement and corresponding to the chronological order in which the sign is to be represented. The display segments are substantially parallel to the surface normals of the support device for the display frame or inclined at an angle of less than 45° to the surface normals and assigned opposite the sightline of the observer.

12 Claims, 2 Drawing Sheets

OPTICAL DISPLAY DEVICE

RELATED APPLICATION AND CLAIM OF PRIORITY

This application is a nationalization of PCT Application No. PCT/EP97/04264 having an international filing date of Aug. 5, 1997, which designates at least one country in addition to the United States and which claims priority from German Application No. 196 31 827.0 filed Aug. 7, 1996. For priority purposes, this application continues the above-noted PCT application and claims the benefit of 35 USC 371 and/or 35 USC 120.

FIELD OF THE INVENTION

This invention is related generally to a visual display, and more particularly to a visual display device for representing characters related to automobile traffic.

BACKGROUND OF THE INVENTION

A visual display device is shown in DE-U 86 07 138.6. In such display device, display segments with one respective character each are swivelably supported around a vertical axis within a support arrangement. In the device shown in DE-U 86 07 138.6, the plane of the support arrangement is aligned essentially perpendicular to the direction of movement of an observer as are the display segments.

In DE-A 34 40 856 a visual display arrangement is shown in which individual rows of image elements are recessed in relation to a vertical plane. Wedge shaped projections are arranged between such rows. This display arrangement with its support arrangement is also aligned essentially vertically.

In another display device according to DE 40 22 650C1 alphanumeric characters, symbols or images can be represented on a flat display board by means of self-illuminating image elements that are illuminated by means of optical fibers. Such display board is suspended in an essentially vertical manner from a mounting surface.

The DE 40 22 650 C1 display device requires a certain minimum height in order to represent figures and permit them to be recognized from a greater distance as is required for highway traffic. In this case the spacial relationship is not favorable with regard to making visual display devices readily visible. For example, structural height is limited in tunnels or in underpasses, so that quite often display devices that are suspended are torn away by trucks.

OBJECTS OF THE INVENTION

It is an object of this invention to provide a visual display device that overcomes some of the short comings of the prior art.

Another object of this invention is to provide a visual display device capable of providing good visibility while having a structural height that is as small as possible. How these and other objects are accomplished will become apparent from the following descriptions and from the drawings.

SUMMARY OF THE INVENTION

The invention involves a visual display device comprised of a display field positioned between a first and second support frame. In this invention, the support frames are aligned essentially parallel to a given direction or movement. Furthermore, the invention includes a plurality of display segments sequentially spaced one behind the other within the display field. These display segments are attached at each end to one of the support frames. Also included are a plurality of illuminating image elements that are positioned within the display segments.

This embodiment of the invention permits the display field to be displaced depth-wise as viewed by an observer traveling parallel to the given direction of movement. As such, very little structural height or width is required while visually, the impression of a continuous display surface is imparted to an observer that is essentially perpendicular to the visual axis of the observer.

This allows the structural height of width of the invention to be considerably less than the visual height or width of the structure (e.g., 3 to 5 cm. for a display height of 60 cm. or more). Depending on whether the display segments are arranged above or lateral to the observer, the display segments can be horizontal or vertical strips appropriately interconnected to a planar display surface.

In one embodiment of the invention, the display segments are inclined opposite the direction or movement by an angle less than 45 degrees. In another embodiment, the display segments have both an upper and lower edge with the lower edges being aligned horizontally and the display segments as seen in succession by an observer moving along the given direction of movement correspond to corresponding strips of a flat display surface in a sequence from top to bottom. In such an embodiment, the width of the display segments can be established depending on the desired structural height, whereby the display segments in a raster display, for example, can be limited to an image element series, and a corresponding number of display segments can be arranged one after the other depth-wise. Thus, in a tunnel or a narrow escape way, the narrow width of the cross section is not narrowed any further. As a result, a simple retrofitting in preexisting installations is possible practically without limitation.

In another version of the embodiment, the display segments are swivelably connected to the support frame. By tilting the display segments with respect to the direction of observation, a very small structural height, or in a lateral arrangement, a small structural width can be achieved even when using broad display segments. Furthermore, the display segments can be aligned for optimal visibility with respect to the observer thereby allowing, for example, a narrow cone of light from an image element to be clearly visible over a greater approach path of an observer.

In another embodiment of the invention, the image elements can be illuminated by optical fibres or light emitting diodes. In still another embodiment, the display segment includes at least one row of image elements. This type of construction allows the image elements to be variably controlled or allocated in connected groups. The positioning of the image elements in rows offers the advantage that the display device can be constructed as flat as possible and that the distance from image element to image element increases uniformly in the direction of depth when approached.

Depending on the circumstances of observation, other variants are possible whereby the display segments, for example, can also be constructed in a curved shape. The entire display device can also be arranged so as to be inclined relative to the direction of movement, dropping downward in the rearward direction, in order to be able to see the individual display segments, if desired, from an even lower view angle.

In a preferred embodiment of the invention, the display segments are comprised of three layers. In such embodiment, the first layer of the display segment is made of a strip of transparent material, the second layer of the display segment is oriented behind the first layer and includes a plurality of openings, and the third layer or the display segment is located behind the second layer and contains the illuminating image elements. In this embodiment, the illuminating image elements contained on the third layer project into the openings of the second layer. Such arrangement allows for the relevant strip of a failed image element to be removed and replaced. It also has an advantage in that reflections from the rear lights of vehicles driving ahead are avoided.

In a still more preferred embodiment of the invention, the support frames attached to the display segments are themselves swivelably attached to a wall or a rack through the use of a swivel mount. This allows the device to be adapted to the viewing direction in certain situations in that the support frames can be swivelably attached to a wall or a rack through the use of a swivel device.

If it is provided that the distance of the raster-like image element transverse to the direction of movement increases from the front to the rear display segment, then a conical advance of the displayed character is avoided in the direction of depth, and a parallel alignment is achieved, as in a usual vertical display surface.

In yet another embodiment of the invention, the visual display device is comprised of a single-piece support plate having a saw-toothed profile. In such embodiment, a plurality of display segments form sections of the single-piece support plate and a plurality of illuminating image elements are positioned within the display segments. In such an embodiment, the simple shielding of the optics in areas between the display segments and simple protection of the optical and electronic components is achieved in that the display segments are sections of a single-piece support plate with a longitudinally saw-tooth shaped profile. Thus, the visible outer surfaces of the support arrangement along with the support plate can advantageously be painted black.

DETAILED DESCRIPTIONS OF THE PREFERRED EMBODIMENTS

Figure 1:
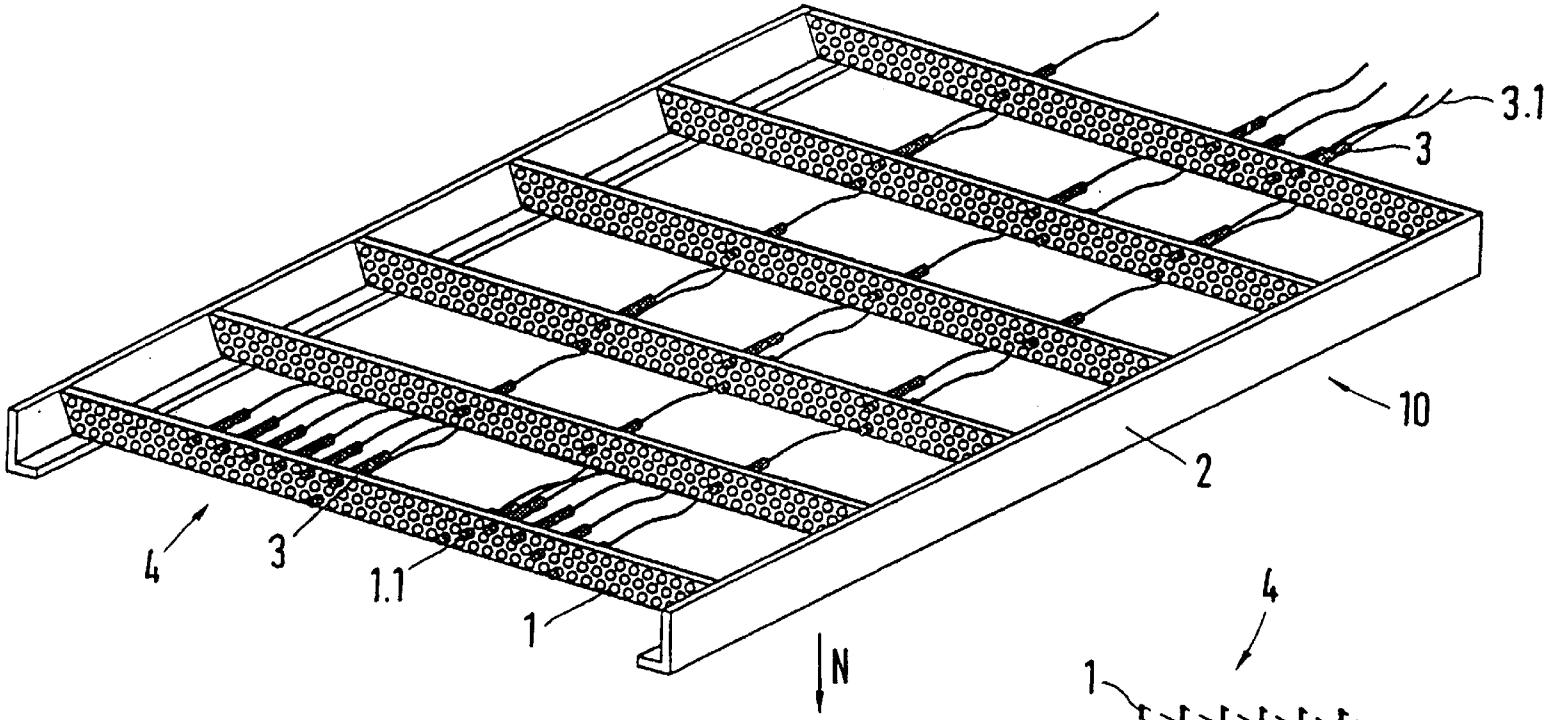
FIG. 1 is a perspective view of a visual display device having successively arranged display segments.

FIG. 1 illustrates a visual display device 10 used to represent characters in the form of alphanumeric data, symbols, images or the like with strip-like, horizontally arranged display segments 1, which in this case each include 3 rows of image elements 1.1. The display segments 1 are attached to a schematically illustrated mount 2 at their lateral end areas.

The display segments 1 are provided with a channel of punched holes into which or across the entire surface, light elements 3 with optical fibers 3.1 or other light elements, such as, for example, LEDs are inserted. Such display segments 1 together form a display field 4.

Figure 2:
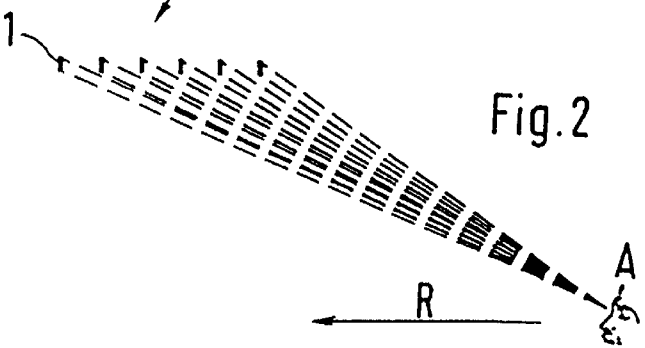
FIG. 2 is a schematic illustration of an observation situation.

In the display field 4, as can also be seen in FIG. 2, the display segments 1 are arranged in succession from front to back as seen by an observer A, whereby the display segments following each other in succession from front to back correspond to strips of a flat display surface in a sequence from top to bottom.

The display segments 1 with their reference surfaces are somewhat inclined toward an observer A, as can also be recognized in FIGS. 1 and 2. Such an incline of the display segments 1 has the advantage that the light cone of the light intensity distribution curve can be optimally directed onto a desired observation area. Furthermore, as a result of the incline of the display segments 1 a flat construction of the display device 10 is also favored.

In another embodiment of the invention, the display segments 1 can be attached swivelably to the mount, in order to achieve an optimal adaptation to the varying observation situations, e.g., depending on the speed of the vehicle.

The width of the display segments 1 can be limited to a minimum extent of only one row of image elements 1.1, in which an appropriate number of display segments 1 are arranged one behind the other. The spacing of the display segments 1 also depends on the observation circumstances and can easily be adapted to the respective situation. It is also possible to swivel the display device 10 in its entirety, whereby, for example, the display device 10 shown in FIG. 1 is swiveled downward at its rear end with respect to the front end.

To attach the display device laterally, a subdivision of an assumed, flat display surface having display segments oriented in the vertical direction can be arranged. Said display segments are arranged in succession one behind the other corresponding to the character which is to be represented, on the right or left side of the direction of movement of the observer, whereby the edge of an appropriately flat display field turned away from the observer is respectively arranged in the front together with the display segments.

In addition to auto traffic, possible applications for the invention include, for example, air traffic, pedestrians or rail traffic.

Figure 3:
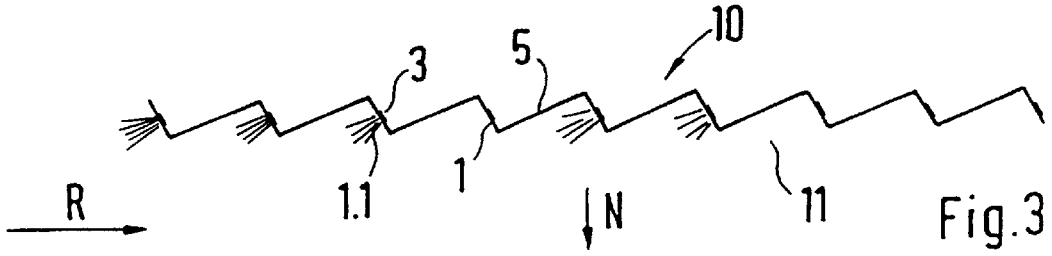
FIG. 3 is a further embodiment of a visual display device in a longitudinal section.

In FIG. 3, a further embodiment of the display device 10 is reproduced in longitudinal section. The display segments 1 are hereby sections of a support plate 11 that is longitudinally profiled in a saw-tooth shape and forms a closed surface. Optical and electronic elements as well as a complete control unit can be arranged above the support plate 11. Alternatively, a control unit for improved operation, e.g., including in a niche of a tunnel, can be provided and can be connected to the display device 10 by means of a lead. According to FIG. 3, there is only one row of lighting elements 3 or image elements 1.1 per display segment 1. The spacing of the image elements increases uniformly in the direction of depth as viewed by the observer when approached. This construction permits the smallest structural height of e.g., 3 cm to 5 cm at a visual display height of e.g., 60 cm or more.

Figure 4:
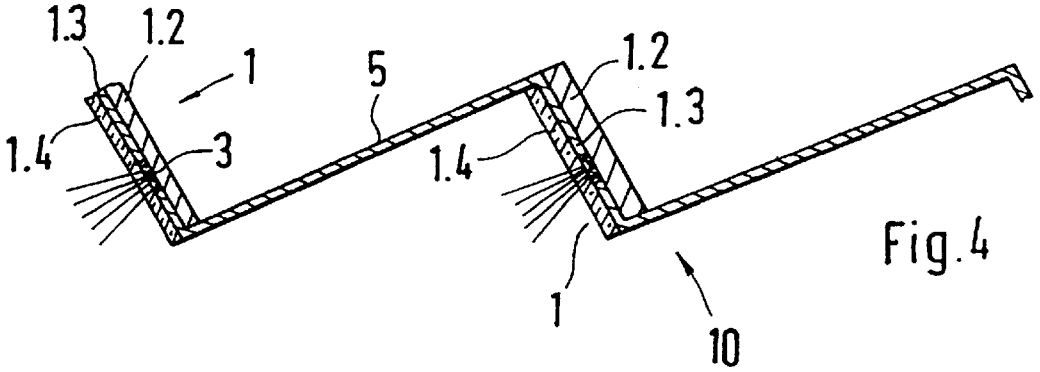
FIG. 4 is a cross-sectional view of the embodiment shown in FIG. 3.

FIG. 4 shows a section of the embodiment shown in FIG. 3. The display segments 1 are thereby built of three layers, whereby on the outer side turned toward the observer a glass strip 1.4, is attached, e.g., by adhesion, while on the back side turned away from the observer a support strip 1.2 with the lighting elements 3 is fastened, for example, by means of two or four screws. The light elements 3 project into penetrations of the segment strip 1.3. With this construction defective lighting elements 3 can simply be exchanged along with the support strip 1.3. Also, reflections on the particular cover used with the glass strips 1.4, for example from rear lights of vehicles driving ahead, are avoided. It is also advantageous to paint the outer sides of the intermediate pieces 5 that are located between the display segments 1 black, so that interfering reflections can be minimized.

Figure 5:
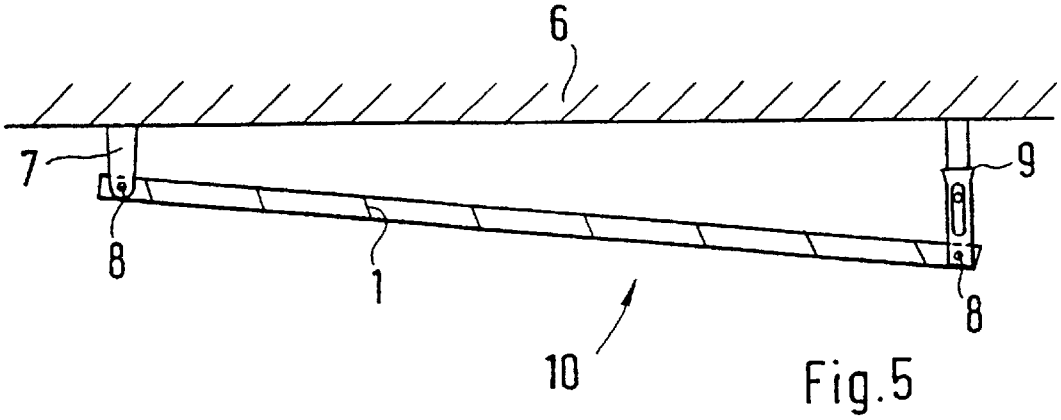
FIG. 5 is a visual display device swivelably attached to the ceiling of a tunnel.

FIG. 5 shows a swivelable mounting of the display device 10 on, for example, a ceiling 6 of a tunnel. The display device 10 is fastened to the ceiling 6 by means of a mounting element 7, and also to an articulation 8 of a support arrangement of the display device, while in the rear area an adjustment element 9 is also attached to an articulation 8 and to the ceiling 6. The display device 10 can be brought from its horizontal position into a slightly inclined position and can be fixed there.

The described construction results in a device of the most flat structural height that is particularly expedient especially in tunnels, whereby the visual height for a good recognition of the characters is assured. Additionally the construction leads to the fact that the character representation when being approached increases rapidly as a result of the change in angle, and can be recognized quickly.

While the principles of this invention have been described in connection with specific embodiments, it should be understood clearly that these descriptions are made only by way of example and are not intended to limit the scope of the invention.

What is claimed is:

1. A visual display device comprised of:

a display field positioned between a first support frame and a second support frame where said support frames are aligned essentially parallel to a given direction of travel along a road surface;

a plurality of display segments sequentially spaced, in the direction of travel, one behind the other within the display field, said display segments each having a first end attached to the first support frame and a second end attached to the second support frame; and a plurality of illuminating image elements positioned within the display segments.

2. The visual display of claim 1 wherein the display segments are inclined opposite the direction or movement by an angle less than 45 degrees.

3. The visual display device or claim 1 wherein:

the display segments have an upper edge and a lower edge; and the lower edges of each of the display segments are aligned horizontally in succession in the given direction of movement.

4. The visual display device of claim 1 wherein the display segments are swivelably connected to the support frame.

5. The visual display device of claim 1 wherein the image elements can be illuminated by optical fibres.

6. The visual display device of claim 1 wherein the image elements are light emitting diodes.

7. The visual display device of claim 1 wherein the display segment includes at least one row of image elements.

8. The visual display device or claim 1 wherein:

the display segments have three layers;

the first layer of the display segment is made of a transparent material;

the second layer of the display segment is oriented behind the first layer and includes a plurality of openings;

the third layer or the display segment is located behind the second layer and contains the illuminating image elements; and the illuminating image elements contained on the third layer project into the openings of the second layer.

9. The visual display device of claim 1 wherein the support frames are swivelably attached to a wall.

10. A visual display device comprised of:

a single-piece support plate having a saw-toothed profile;

a plurality of display segments aligned essentially parallel to a given direction of travel along a road surface wherein the display segments are sections of the single-piece support plate having a saw-toothed profile; and a plurality of illuminating image elements positioned within the display segments.

11. The visual display device of claim 10 wherein:

the display segments have three layers;

the first layer of the display segment is made of a transparent material;

the second layer of the display segment is oriented behind the first layer and includes a plurality of openings;

the third layer of the display segment is located behind the second layer and contains the illuminating image elements; and the illuminating image elements contained on the third layer project into the openings of the second layer.

12. The visual display device of claim 10 wherein the support plate is swivelably mounted to a wall.

* * * * *

UNITED STATES PATENT AND TRADEMARK OFFICE

CERTIFICATE OF CORRECTION

PATENT NO. : 6,150,949
DATED : November 21, 2000
INVENTOR(S) : Bernd Eschbach and Erwin Baumstark It is certified that error appears in the above-identified patent and that said Letters Patent is hereby corrected as shown below:

Abstract,
The first part of the first sentence of the Abstract was dropped by the PTO. Also, the word "optical" in the first sentence should read "visual." Therefore, please delete the first sentence of the Abstract and replace it with the following:
-- The invention concerns a visual display device for the representation of signs, especially road signs, in a display frame attached to a support device. --

Title page,
Please delete the title "Optical Display Device" replace it with: -- Visual Display Device --

Column 1,
Line 1: please delete the word "OPTICAL" replace with the word -- VISUAL --

Column 2,
Line 11: please delete "height of" replace with -- height or --

Column 3,
Line 3: please delete "layer or" replace with -- layer of --
Line 20: please delete "transverse" replace with -- transverses --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*